US005626284A

United States Patent [19]

Franzen

[11] Patent Number: 5,626,284

[45] Date of Patent: May 6, 1997

[54] DIVIDABLE PARTITION ASSEMBLY

[75] Inventor: John J. Franzen, Oconomowoc, Wis.

[73] Assignee: Rock-Tenn Company, Norcross, Ga.

[21] Appl. No.: 562,030

[22] Filed: Nov. 22, 1995

[51] Int. Cl.[6] ..... B65D 5/49

[52] U.S. Cl. ..... 229/120.36; 229/120.38; 493/90; 493/91

[58] Field of Search ..... 229/120.36, 120.38; 217/30, 31, 32; 493/90, 91, 390, 391

[56] References Cited

U.S. PATENT DOCUMENTS 3,263,894 8/1966 Matson ..... 229/120.38
3,483,802 12/1969 Heyne ..... 493/91
3,921,893 11/1975 Randle, Jr. ..... 229/120.38
4,361,264 11/1982 Phillips ..... 229/120.36
4,621,764 11/1986 Ragon ..... 493/91

*Primary Examiner*—Gary E. Elkins
*Attorney, Agent, or Firm*—Howell & Haferkamp, L.C.

[57] ABSTRACT

A partition assembly, which defines a plurality of compartments for separating articles to be packaged in a container includes break-away segments which allow the assembly to be easily separable into smaller partition assemblies upon insertion into the container.

20 Claims, 1 Drawing Sheet

DIVIDABLE PARTITION ASSEMBLY

BACKGROUND OF THE INVENTION

The present invention pertains to a partition assembly which defines a plurality of compartments for use in a container. More particularly, the present invention pertains to a partition assembly for separating articles to be packaged in a container, where the partition assembly includes break-away segments which allow the assembly to be easily separable into smaller partition assemblies upon insertion into the container.

Partition panels are commonly used in carton packaging, such as cardboard or paperboard boxes, for separating articles packaged in the boxes and preventing the articles from contact with one another when shipped or stored. This is particularly true for glass articles, such as bottles and other similar articles, but is also true in packaging easily bruised food items such as fruits and vegetables and in packaging eggs. A typical partition assembly is comprised of several panels arranged in a crisscrossing pattern in the interior of the carton where the crisscrossing panels define several separate storage areas in the carton interior. Prior art partition panels typically extend from the bottom to the top of the container and provide added compression strength to the container in addition to separating the container interior into separate storage areas.

A prior art partition assembly is typically comprised of a plurality of rectangular panels of paperboard or cardboard or other similar material. A first set of the panels includes a series of one or more slots extending inward, in parallel manner, from an edge of each panel and terminating within the panel. A second set of the panels, equal in number to the number of slots on the first set of panels, includes a series of similar slots which cooperate with the series of slots on the first set of panels. The second set of panels are arranged perpendicular to the first set of panels and the slots in each set of panels cooperate by engaging with one another to form a partition assembly. The partition assembly is then inserted into the carton interior to divide the interior into separate areas, each to receive an article to be packaged in the container.

By varying the number of first and second panels, and the number of slots in each panel, various arrays of partition assemblies can be constructed. Typical arrays include partition assemblies defining 6, 8, 12, 18, and 24 compartments in a container.

In order to prevent against inadvertent disassembly, partition assemblies typically include means for disengageably interlocking the partition panels to one another. The panels may include corresponding tabs and tab receiving openings such that the tabs of one set of panels are received in and are retained within tab receiving openings of the other set of panels, thus interlocking the sets of panels together. Some known assemblies have such tabs and tab receiving openings near the edges of the panels, while other known assemblies have the tabs and tab receiving openings located inward from the edges of the panels.

SUMMARY OF THE INVENTION

The present invention provides a partition assembly comprising a set of lateral panels which engage a set of longitudinal panels. The partition assembly is configured to be inserted into the interior of a container to subdivide the container interior into an array of smaller compartments or cells. The partition assembly is also configured to be easily separable into smaller partition assemblies upon insertion of the assembly into a container having a center dividing wall in its interior.

The partition assembly of the present invention is used in the interior of a conventional box container having a bottom surrounded by four walls that project vertically from the peripheral edge of the bottom. Additionally, the partition assembly can be used in a container having a dividing wall which divides the container in half longitudinally. One embodiment of such a container is provided with a dividing wall formed by placing two conventional box containers side by side against one another in a tray, wherein the adjacent sidewalls of the two containers form the dividing wall. Alternatively, the container with dividing wall can be formed without a tray, where the adjacent sidewalls of the two side by side box containers are affixed to each other with a tear-away fastening means, enabling the container to be broken into two separate containers if so desired. Containers with more than one dividing wall can also be formed by placing more than two box containers next to one another as described above. Still further, the dividing wall can be a single wall that divides the interior of the container.

The partition assembly is generally comprised of a plurality of crisscrossing lateral and longitudinal panels, each having a series of slots extending partially through their widths in parallel. The lateral panels are arranged generally perpendicular to the longitudinal panels. The slots on the lateral panels cooperate with the slots on the longitudinal panels by engaging them to connect the panels together in their crisscrossing configuration to form a partition assembly.

Preferably, each set of panels includes tabs which correspond to tab receiving openings on the other set of panels. The tabs of each set of panels are received in and are retained within tab receiving openings of the other set of panels. The lateral and longitudinal panels are thereby disengageably interlocked with one another so as to prevent inadvertent disassembly.

Each longitudinal panel that is designed to separate into two sections includes a perforated section located at the mid point of the panel which extends vertically through the entire width of the panel. Before the interlocked partition assembly is inserted into the container, the assembly is positioned above the container so that the perforated section of each longitudinal panel is directly over the dividing wall. As the interlocked partition assembly is inserted into the container, the dividing wall of the container acts against the perforated sections of the longitudinal panels and causes the partition assembly to divide into two smaller partition assemblies by tearing the longitudinal panels along the perforated sections. Each longitudinal panel can also be made to have more than one perforated section, for use in a container having more than one dividing wall, so that the resulting partition assembly is capable of multiple divisions.

The dividable partition assembly of the present invention can be employed, for example, with packaging for a 24-pack case of bottles, wherein the interlocked partition assembly is comprised of three longitudinal panels, each with one perforated section at the midpoint, and four lateral panels. The interlocked assembly of panels is placed into a container having a dividing wall, as described above, which centrally divides it into two 12 pack partitions. Each longitudinal panel is divided along the perforated section into two halves. When the larger partition assembly is divided, three such halves of the longitudinal panels intersecting with two lateral panels form each 12-pack partition.

The same interlocked partition assembly can also be used in an ordinary 24-pack container having no dividing wall. As such, only one manufacturing process is needed to manufacture panels for a partition assembly capable of being used either as an ordinary 24-pack partition or as a dividable partition assembly for use in a 24-pack case which can be broken into two 12 packs if so desired.

Standard packaging equipment and machinery can be used to assemble and insert the dividable partition assembly of this invention. It is common in the industry for partition assemblies to be automatically inserted into containers by standard packaging machines. In the present invention, the partition assembly is severed by the dividing wall of the container as the partition assembly is inserted into the container. Therefore, no additional steps in standard manufacturing or assembly processes are needed for dividing the partition assembly. As such, packagers can readily use the dividable partition assembly of this invention without substantial modifications or additions to existing standard packaging equipment and machinery.

The divisibility feature offers convenience to manufacturers, distributors and retailers of goods that are packaged or shipped in such containers by providing flexibility. Goods can be stored, displayed, and sold with containers in their unitary form or divided form.

While the principle advantages and features of the present invention have been described above, a more complete and thorough understanding and appreciation for the invention may be attained by referring to the drawings and description of the preferred embodiment which follow.

DETAILED DESCRIPTION OF A PREFERRED EMBODIMENT

Figure 1:
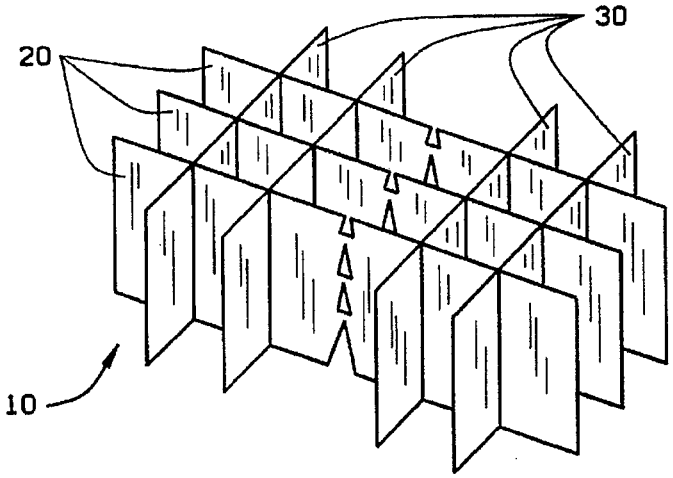
FIG. 1 is an isometric view of a dividable partition assembly constructed according to the principals of this invention, shown in assembled form.

A dividable partition assembly, for defining a plurality of compartments in a container, constructed according to the principals of this invention is indicated generally as 10 in FIG. 1. The partition assembly 10 comprises a plurality of lateral panels 30 which engage a plurality of longitudinal panels 20. The partition assembly 10 is configured to be easily separable into two smaller partition assemblies upon insertion of the assembly into a container.

Figure 4:
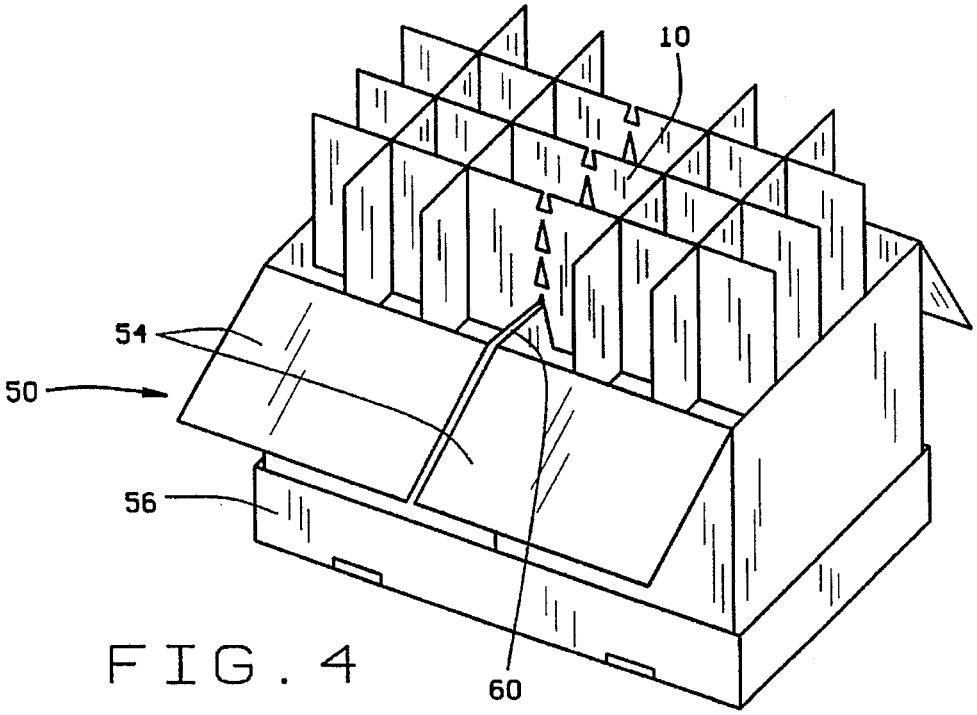
FIG. 4 is an isometric view of a dividable partition assembly positioned over a container. The container in FIG. 4 is depicted as two boxes placed side by side in a tray.

The partition assembly 10 of the present invention can be used in the interior of a conventional box type container. One embodiment of such a container is shown as 50 in FIG. 4. Preferably, the container 50 has a dividing wall 60 which divides the container 50 in half longitudinally. The embodiment of a container 50 with dividing wall 60, as depicted in FIG. 4, is formed by placing two conventional box containers 54 side by side in a tray 56. Each of the two containers 54 have a bottom surrounded by four walls that project vertically from the peripheral edge of the bottom. When the two containers 54 are positioned side by side, the adjacent side walls form the dividing wall 60. Alternatively, a container with a dividing wall can be formed without a tray 56 where the two side by side box containers 54 are fixed to each other with a tear-away fastening means enabling the container to be broken into two separate containers if so desired. Still further, a container with a single dividing wall that is not separable into two smaller containers can be used with the partition assembly of the invention.

Figure 2:
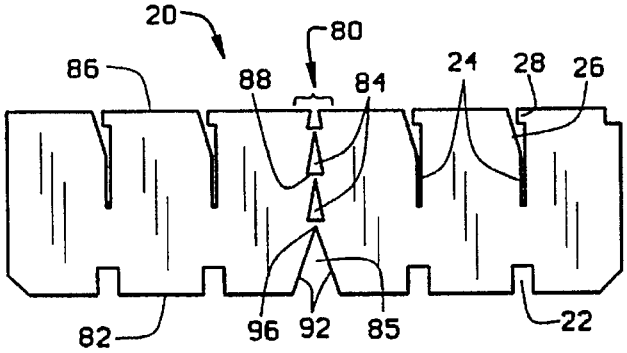
FIG. 2 is an elevation view of one longitudinal panel of the partition assembly.
Figure 3:
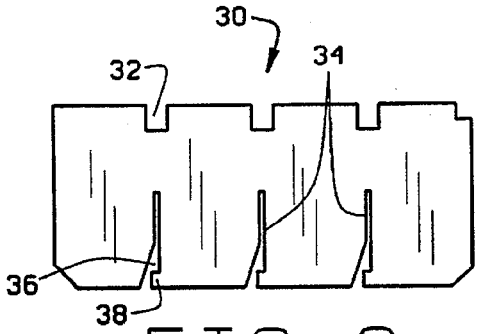
FIG. 3 is an elevation view of one lateral panel of the partition assembly.

FIG. 2 is an elevation view of one longitudinal panel 20. Each longitudinal panel 20 has one or more upwardly opening slots 24 extending partially through its width. FIG. 3 is an elevation view of one lateral panel 30. Each lateral panel 30 has one or more downwardly opening slots 34 extending partially through its width. The partition assembly 10 is generally comprised of a plurality of crisscrossing lateral panels 30 and longitudinal panels 20. The panels 20,30 are arranged generally perpendicular to each other, and the slots 24,34 cooperate by engaging one another to connect the panels 20,30 together in their crisscrossing configuration to form an partition assembly 10.

In order to prevent inadvertent disassembly, the preferred embodiment includes a means for disengageably interlocking the panels 20, 30 to one another. A short distance from its open edge, each slot 24, 34 diverges from its centerline to provide an access opening 26, 36 to each slot 24, 34. A tab 28, 38 extends from the other side of each slot 24, 34 and extends part way across the access opening 26, 36. Each longitudinal panel 20 includes tabs 28 which correspond to tab receiving openings 32 on the lateral panels 30. Likewise, each lateral panel 30 includes tabs 38 which correspond to tab receiving openings 22 on the longitudinal panels. The centerline of each tab receiving opening 22, 32 is in alignment with the centerline of each slot 24, 34. The access openings 36 of the lateral panels are placed over the access openings 26 of the longitudinal panels and the two panels 20, 30 are pressed together until the tops of the downwardly opening slots 34 engage the bottoms of the upwardly opening slots 24. The tabs 28, 38 of each set of panels 20, 30 are received in and are retained within tab receiving openings 32, 22 of the other set of panels. This procedure is repeated until all lateral panels 30 have been interlocked with all longitudinal panels 20. The lateral panels 30 and longitudinal panels 20 are thereby disengageably interlocked with one another to form an interlocked partition assembly 10. Although the preferred embodiment includes the above described tabs and tab receiving openings for interlocking the panels to one another, it is understood that a dividable partition assembly can be constructed according to the principles of this invention with an alternative means, or no means, of interlocking the panels.

As shown in FIG. 2, each longitudinal panel 20 includes a perforated section 80 located at the mid-point of the panel 20 which extends vertically through the entire width of the panel. When the interlocked partition assembly 10 is inserted into the container 50, the dividing wall 60 of the container 50 acts against the perforated sections 80 of the longitudinal panels 20 and causes the partition assembly 10 to divide into two smaller partition assemblies by tearing the perforated sections 80.

Preferably, the perforated sections 80 comprise a plurality of apertures 84, 85 that are shaped to encourage the tearing of the perforated sections in a predictable or preferred direction along the apertures. The apertures are shown having a triangular shape which accomplishes this desired objective. However, the triangular shape of the apertures is illustrative only and the apertures could have other shapes which result in the tearing of the panels along the apertures. The apertures are arranged in a vertical series extending from the bottom edge 82 to the top edge 86 of each longitudinal panel 20. Each triangular aperture 84, 85 has a substantially horizontal base 88 and two sides 92 of equal length pointing upwardly away from the base 88. The two upward pointing sides 92 of each triangular aperture 84, 85 form an inverted "V" shape which serves to accept the dividing wall 60 of the container 50 therein when the interlocked partition assembly 10 is inserted into the container 50. As the interlocked partition assembly 10 is forced downward into the container 50, the dividing wall 60 tears the perforated section 80 at the top 96 of the lower most triangular apertures 85. The assembly 10 continues its downward movement into the container 50 until the dividing wall 60 has torn through the rest of the triangular apertures 84 in each perforated section 80, thereby severing the partition assembly 10 into two smaller partition assemblies. Once severed, the two smaller assemblies can be placed fully within the two side by side containers 54 to define a plurality of compartments within each container 54.

The preferred embodiment of a dividable partition assembly, as depicted in FIG. 1, includes three longitudinal panels 20 interlocked with four lateral panels 30. Such an embodiment of the present invention defines 24 compartments and can be used, for example, with packaging for a 24-pack case of bottles. As shown in FIG. 4, the preferred embodiment of the interlocked partition assembly 10 is placed into a container 50 having a dividing wall 60, as described above, which divides the assembly 10 into two 12-pack partitions. Each longitudinal panel 20 is divided along the perforated section 80 into two half panels. When the larger partition assembly 10 is divided, three such halves of the longitudinal panels 20 remain assembled with two lateral panels 30 to form each 12-pack partition. Although FIGS. 1 and 4 show a dividable partition assembly 10 constructed from three longitudinal panels 20 and four lateral panels 30 to form a 24 pack (or 12+12 pack) container, it is understood that alternate embodiments of the present invention could be constructed with any combination of lateral panels and dividable longitudinal panels to construct dividable containers of various capacities according to the principles of this invention. Moreover, partition assemblies capable of multiple divisions can be constructed by including a plurality of perforated sections along the panels of the assemblies for use in containers having a plurality of dividing walls.

Although the illustrated embodiment of the present invention is described herein with reference to the accompanying drawings, it is to be understood that the invention is not limited to that precise embodiment and various changes and modifications may be effected therein by one skilled in the art without departing from the scope of the invention. The scope of the invention is defined solely by the claims, and their equivalents.

What is claimed is:

1. A dividable partition assembly defining a plurality of compartments for use in a container having an interior with a longitudinal length and a lateral width, said container further consisting of at least two substantially identical subcontainers positioned side by side and serving to divide said container longitudinally, each subcontainer interior being defined by a horizontal bottom surrounded by laterally opposite front and back walls and longitudinally opposite left and right side walls, the walls having substantially equal vertical heights, the right side wall of one subcontainer and the left side wall of the other subcontainer serving to form a dividing wall which divides said container longitudinally, said partition assembly comprising:

a plurality of longitudinal panels having a breakaway segment located at the center of each longitudinal panel allowing said longitudinal panels to be divided in half; and a plurality of lateral panels engaging said longitudinal panels.

2. The dividable partition assembly of claim 1, wherein said longitudinal panels have a length substantially equal to the longitudinal length of said container enabling said longitudinal panels to be placed parallel to one another in the interior of said container spanning the longitudinal length of said container.

3. The dividable partition assembly of claim 2, wherein said lateral panels have a length substantially equal to the lateral width of said container enabling said lateral panels to be placed parallel to one another in the interior of said container spanning the lateral width of said container.

4. The dividable partition assembly of claim 1, wherein said lateral panels are positioned perpendicularly to said longitudinal panels, thereby defining a multiplicity of lines of intersection, said lateral panels and said longitudinal panels engaging and interlocking with one another at the lines of intersection, thereby forming an interlocked partition assembly for defining a plurality of compartments within said container.

5. The dividable partition assembly of claim 4, wherein said interlocked partition assembly is configured to be easily separable into two smaller partition assemblies for use in the two adjacent subcontainers.

6. The dividable partition assembly of claim 4, wherein said break-away segment includes a perforated section allowing said longitudinal panels to be torn in half along the perforated section.

7. The dividable partition assembly of claim 6, wherein the perforated section of each longitudinal panel further comprises a plurality of apertures arranged in a vertical series through each longitudinal panel, the perforated section allowing said partition assembly to be easily separated into two smaller partition assemblies.

8. The dividable partition assembly of claim 7, wherein each aperture in the vertical series has a shape that directs a tear made in the panel in a predetermined direction through the panel.

9. The dividable partition assembly of claim 8, wherein each aperture has a bottom and a top and a lateral width across the aperture that increases as the aperture extends from its bottom to its top.

10. The dividable partition assembly of claim 9, wherein the perforated section of each longitudinal panel is configured so that it will tear at the top of the lower most aperture when the partition assembly is inserted into the container by the dividing wall being forced upwardly into the lower most aperture, and wherein apertures in the series of apertures above the lower most aperture are positioned to tear in an upwardly progressing sequence when the partition assembly is inserted into the container by the dividing wall continuing to be forced upwardly along the vertical series of apertures of the perforated section until a top most of the apertures is torn, to thereby completely sever the interlocked partition assembly into two smaller partition assemblies.

11. The dividable partition assembly of claim 10, wherein the two smaller partition assemblies are dimensioned to be placed fully within the interiors of the two adjacent subcontainers upon the complete separation of the interlocked partition assembly, to thereby define a plurality of compartments within each subcontainer.

12. A method of assembling a dividable partition assembly which defines a plurality of compartments into a container having an interior with a longitudinal length and a lateral width, said container further consisting of at least two substantially identical subcontainers positioned side by side and serving to divide said container longitudinally, each subcontainer interior being defined by a horizontal bottom surrounded by laterally opposite front and back walls and longitudinally opposite left and right side walls, the walls having substantially equal vertical heights, the right side wall of one subcontainer and the left side wall of the other subcontainer serving to form a dividing wall which divides said container longitudinally, the method comprising the steps of:

(a) forming a plurality of lateral panels having a length substantially equal to the lateral width of said container enabling said lateral panels to be placed parallel to one another in the interior of said container spanning the lateral width of said container;

(b) forming a plurality of longitudinal panels each having at least one perforated section and a length substantially equal to the longitudinal length of said container enabling said longitudinal panels to be placed parallel to one another in the interior of said container spanning the longitudinal length of said container;

(c) interlocking said lateral panels with said longitudinal panels, thereby forming an interlocked partition assembly;

(d) positioning the interlocked partition assembly above said container so that the perforated section of each longitudinal panel is directly over the dividing wall;

(e) moving the interlocked partition assembly downward into said container so that the perforated section is torn by the dividing wall, thereby severing the interlocked partition assembly into smaller partition assemblies; and (f) positioning the smaller partition assemblies completely inside the interiors of the adjacent subcontainers so that the assemblies are resting on the bottoms of the subcontainers, thereby defining a plurality of compartments within each subcontainer.

13. The method of claim 12, wherein the step of forming the plurality of longitudinal panels comprises forming the perforated section of each longitudinal panel to include a plurality of apertures arranged in a vertical series with each aperture having a shape that directs a tear made in the panel in a predetermined direction through the panel.

14. The method of claim 13, wherein the step of interlocking said lateral panels with said longitudinal panels includes positioning said lateral panels perpendicularly to said longitudinal panels, thereby defining a multiplicity of lines of intersection, said lateral panels and said longitudinal panels engaging and interlocking with one another at the lines of intersection, thereby forming an interlocked partition assembly for defining a plurality of compartments within said container.

15. The method of claim 14, wherein the step of moving the interlocked partition assembly downward into said container includes positioning the lower most aperture in each longitudinal panel over the dividing wall to accept the dividing wall therein, and moving the interlocked partition assembly downward into said container until the perforated section in each longitudinal panel first tears at the top of a lower most aperture and then tears at the top of each consecutive aperture in the vertical series as the assembly continues its downward movement until the top of a top most aperture is torn, thereby completely severing the interlocked partition assembly into smaller partition assemblies.

16. The method of claim 12, wherein the steps of forming said lateral panels and said longitudinal panels include stamping fiber board with dies having the shapes of said panels.

17. A dividable partition assembly defining a plurality of compartments for use in a container having an interior with a longitudinal length and a lateral width, said container further consisting of at least two subcontainers positioned adjacent to one another, each subcontainer having an interior defined by a horizontal bottom surrounded by four walls that project vertically from the peripheral edge of the bottom, the walls having substantially equal vertical heights, at least one wall of each subcontainer being positioned against at least one wall of another subcontainer, the adjacent walls serving to form a dividing wall which divides the interior of said container along the adjacent walls, said partition assembly comprising:

a plurality of longitudinal panels having at least one break-away segment allowing said longitudinal panels to be divided at said break-away segments; and a plurality of lateral panels engaging said longitudinal panels.

18. The dividable partition assembly of claim 17, wherein said lateral panels and said longitudinal panels engage and interlock with one another in a perpendicular crisscrossing pattern so that an interlocked partition assembly is formed, the interlocked partition assembly being capable of division along the break-away segments of each longitudinal panel, thereby forming at least two smaller partition assemblies.

19. The dividable partition assembly of claim 18, wherein the lower most portion of each break-away segment is configured for accepting a dividing wall of said container upon insertion of the interlocked partition assembly into said container.

20. The dividable partition assembly of claim 19, wherein the break-away segments are positioned on the longitudinal panels where the dividing wall will act against each break-away segment as the partition assembly is inserted into the container so that each longitudinal panel is broken along the break-away segment as the interlocked partition assembly is inserted into said container, thereby dividing the interlocked partition assembly into at least two smaller partition assemblies.

* * * * *